US006447592B1

(12) United States Patent
Taniguchi

(10) Patent No.: US 6,447,592 B1
(45) Date of Patent: Sep. 10, 2002

(54) INK COMPOSITION FOR INK JET TEXTILE PRINTING

(75) Inventor: Makoto Taniguchi, Nagano-Ken (JP)

(73) Assignee: Seiko Epson Corporation, Tokyo-To (JP)

( * ) Notice: Subject to any disclaimer, the term of this patent is extended or adjusted under 35 U.S.C. 154(b) by 0 days.

(21) Appl. No.: 09/521,565

(22) Filed: Mar. 9, 2000

(30) Foreign Application Priority Data

Mar. 12, 1999 (JP) ..... 11-067161
Oct. 21, 1999 (JP) ..... 11-299857

(51) Int. Cl.[7] ..... C09D 11/02
(52) U.S. Cl. ..... 106/31.58; 106/31.43; 106/31.59
(58) Field of Search ..... 106/31.58, 31.43, 106/31.59

(56) References Cited

U.S. PATENT DOCUMENTS 4,702,742 A * 10/1987 Iwata et al. ..... 8/495
5,180,425 A * 1/1993 Matrick et al. ..... 106/31.58
5,356,464 A * 10/1994 Hickman et al. ..... 106/31.36
5,360,472 A * 11/1994 Radigan, Jr. et al. .... 106/31.51
5,395,434 A * 3/1995 Tochihara et al. ..... 106/31.43
5,594,485 A * 1/1997 Koike et al. ..... 347/101
5,776,230 A * 7/1998 Gundlach et al. ..... 106/31.43
5,910,211 A * 6/1999 Ueda et al. ..... 106/31.43
5,952,414 A * 9/1999 Noguchi et al. ..... 524/377

FOREIGN PATENT DOCUMENTS

JP 05-255627 10/1993 ..... C09D/11/00
JP 06-25576 2/1994 ..... C09D/11/00
JP 07-258982 10/1995 ..... D06P/5/00
JP 09-296380 11/1997 ..... D06P/5/00

OTHER PUBLICATIONS

JPO Abstract 05(1993)–255627, Oct. 5, 1993.
JPO Abstract 06(1994)–255576, Feb. 1, 1994.
JPO Abstract 07(1995)–258982, Oct. 9, 1995.
JPO Abstract 09(1997)–296380, Nov. 18, 1997.

* cited by examiner

*Primary Examiner*—Helene Klemanski
*Assistant Examiner*—Veronica F. Faison
(74) *Attorney, Agent, or Firm*—Ladas & Parry

(57) ABSTRACT

Disclosed are ink compositions, which can satisfy, on a high level, various properties required of ink compositions for ink jet textile printing and can realize good printed images, and an ink jet textile printing method using the same. An ink composition comprising at least an acid dye, a surfactant, water, and at least one compound represented by formula (I), the ink composition having a viscosity of not more than 8.0 m.Pa.s (20° C.), is printed on a woven fabric by means of a piezoelectric vibrator type ink jet recording head:

(I)

$$\begin{array}{l} CH_2\text{—}(EP1)l\text{—}OH \\ | \\ CH\text{—}(EP2)m\text{—}OH \\ | \\ CH_2\text{—}(EP3)n\text{—}OH \end{array}$$

wherein EP1, EP2, and EP3 each independently represent an ethyleneoxy or propyleneoxy group; and ;, m, and n each are independently 0 of a natural number of 1 or more, provided that at least one of l, m, and n is 1 or more with the average of l+m+n in the whole compound represented by formula (I) contained in the ink composition being 1 to 30.

24 Claims, 2 Drawing Sheets

INK COMPOSITION FOR INK JET TEXTILE PRINTING

BACKGROUND OF THE INVENTION

1. Field of the Invention

The present invention relates to an ink composition suitable for use in printing on woven fabrics, especially animal fibers including silk and wool, and polyamide fibers including nylon, by ink jet recording, and an ink jet textile printing method using the same.

2. Background Art

Ink jet recording is a printing method wherein droplets of an ink composition are ejected and deposited onto a recording medium, such as paper, to conduct printing. This method has a feature that an image having high resolution and high quality can be printed at a high speed by means of relatively inexpensive apparatuses.

The application of the ink jet recording to textile printing permits various images to be easily formed on fabrics. This is particularly advantageous in the formation of images having excellent gradation, multicolor rendering and other properties. Further, unlike the conventional textile printing process, substantially no excessive ink composition is created. Therefore, the application of the ink jet recording to textile printing is advantageous also from the viewpoint of the environmental protection.

Matters, which are important to the application of the ink jet recording to textile printing, include that the ink composition can realize highly color developed printed image, the ink composition can have viscosity low enough to be suitable for ink jet recording, the ink composition can favorably match a pretreatment agent for woven fabrics to realize good images, the drying of printed images is relatively fast and, for example, any offset does not occur at the time of winding of the woven fabric after textile printing, and, in addition, the ink composition can be stably stored for a long period of time.

Ink jet textile printing methods, wherein textile printing is carried out by ink jet recording, are disclosed, for example, in Japanese Patent Laid-Open Nos. 255627/1993, 25576/1994, 258982/1995, and 296380/1997.

SUMMARY OF THE INVENTION

The present inventors have now found an ink composition which can satisfy, on a high level, various properties required of ink compositions for ink jet textile printing and can realize good printed images.

Accordingly, it is an object of the present invention to provide an ink composition, which can satisfy, on a high level, various properties required of ink compositions for ink jet textile printing and can realize good printed images, and an ink jet textile printing method using the same.

According to the present invention, there is provided an ink composition for ink jet textile printing, comprising at least an acid dye, a surfactant, water, and at least one compound represented by formula (I), said ink composition having a viscosity of not more than 8.0 m.Pa.s (20° C.):

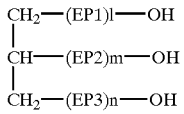

(I)

wherein

EP1, EP2, and EP3 each independently represent an ethleneoxy or propyleneoxy group; and l, m, and n each are independently 0 or a natural number of 1 or more, provided that at least one of l, m, and n is 1, or more with the average of l+m+n in the whole compound represented by formula (I) contained in the ink composition being 1 to 30.

The ink composition according to the present invention can satisfy, on a high level, various properties required of ink compositions for ink jet textile printing. For example, the ink composition according to the present invention can realize highly color developed printed images in textile printing. In particular, the utilization of the compound represented by formula (I) can reduce the amount of the so-called wetting agent, such as glycerin, added to the ink composition and can increase the content of water as a main solvent in the ink composition. As a result, an acid dye as a colorant can be present in a larger amount in the ink composition, leading to an advantage that printed images having high print density can be realized. Further, the ink composition according to the present invention is highly compatible with ink jet recording, especially a piezoelectric vibrator type ink jet recording head. Moreover, the ink composition according to the present invention has an additional advantage that printed images are relatively fast drying. In the present invention, drying associated with the ink composition refers to the evaporation of volatile components in the ink composition to fix the solid component onto woven fabrics, and, in addition, connotes that, for example, the printed image becomes dry to the touch as a result of the penetration of the ink composition into woven fabrics. Moreover, the ink compositions according to the present invention have good long-term storage stability.

DESCRIPTION OF THE PREFERRED EMBODIMENTS

Figure 1:
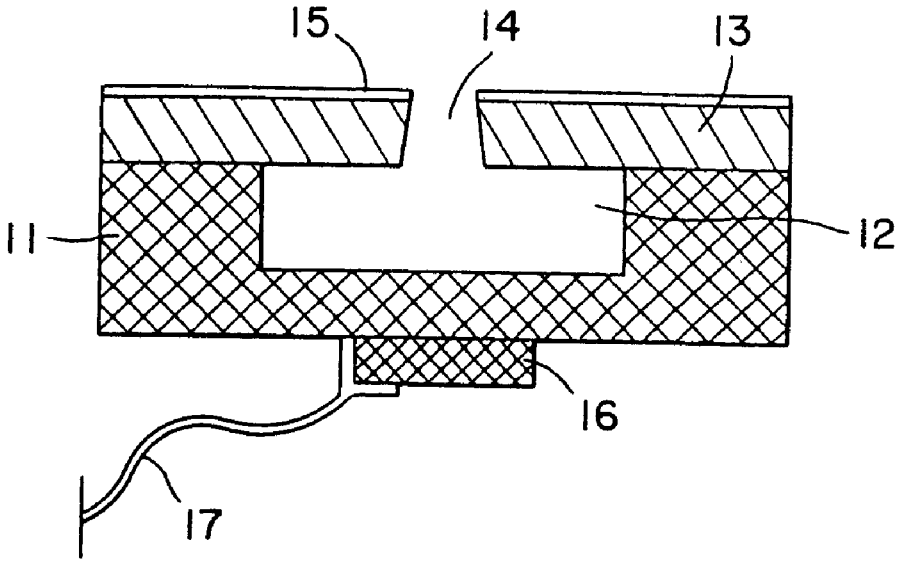
FIG. 1 is a diagram showing one embodiment of an ink jet recording head which can favorably eject the ink composition of the present invention and comprises a member 11 defining an ink passage, an ink passage 12, a member 13 defining a face having an ink ejection port 14, an ink-repellent, surface-treated layer 15, composed of a codeposit of a fluoropolymer, provided on the surface of the member 13, a piezoelectric element 16, and a drive line 17 for driving the piezoelectric element.

Ink compositions for ink jet textile printing (1) Acid dye

Acid dyes usable in the ink composition of the present invention include azo dyes, anthraquinone dyes, carbonium dyes, nitro dyes, and metal complex dyes. Specific examples thereof include, as the four basic colors of printing or colors close to these colors, C.I. Acid yellow 1, 3, 7, 11, 17, 19, 23, 25, 29, 36, 38, 40, 42, 44, 49, 59, 61, 70, 72, 75, 76, 78, 79, 98, 99, 110, 111, 112, 114, 116, 118, 119, 127, 128, 131, 135, 141, 142, 161, 162, 163, 164, 165, 169, 207, 219, and 246;

C.I. Acid Red 1, 6, 8, 9, 13, 14, 18, 19, 24, 26, 27, 28, 32, 35, 37, 42, 51, 52, 57, 62, 75, 77, 80, 82, 83, 85, 87, 88, 89, 92, 94, 95, 97, 106, 111, 114, 115, 117, 118, 119, 129, 130, 131, 133, 134, 138, 143, 145, 149, 154, 155, 158, 168, 180, 183, 184, 186, 194, 198, 199, 209, 211, 215, 216, 217, 219, 249, 252, 254, 256, 257, 260, 262, 265, 266, 274, 276, 282, 283, 303, 317, 318, 320, 321, 322, and 361;

C.I. Acid Blue 1, 7, 9, 15, 22, 23, 25, 27, 29, 40, 41, 43, 45, 49, 54, 59, 60, 62, 72, 74, 78, 80, 82, 83, 90, 92, 93, 100, 102, 103, 104, 112, 113, 117, 120, 126, 127, 129, 130, 131, 133, 138, 140, 142, 143, 151, 154, 158, 161, 166, 167, 168, 170, 171, 175, 182, 183, 184, 185, 187, 192, 199, 203, 204, 205, 225, 229, 234, 236, and 300; and C.I. Acid Black 1, 2, 7, 24, 26, 29, 31, 44, 48, 50, 51, 52, 58, 60, 62, 63, 64, 67, 72, 76, 77, 94, 107, 108, 109, 110, 112, 115, 118, 119, 121, 122, 131, 132, 139, 140, 155, 156, 157, 158, 159, 191, and 234.

Dyes other than those of the basic four colors, such as dyes of orange, violet, green, and brown, may be suitably used from the viewpoints of broadening the range of color rendering or reducing a specific color(s) of printed images. Specific examples of such dyes include:

C.I. Acid Orange 1, 7, 8, 10, 19, 20, 24, 28, 33, 41, 43, 45, 51, 56, 63, 64, 65, 67, 74, 80, 82, 85, 86, 87, 88, 95, 122, 123, and 124;

C.I. Acid Violet 7, 11, 15, 31, 34, 35, 41, 43, 47, 48, 49, 51, 54, 66, 68, 75, 78, 97, and 106;

C.I. Acid Green 3, 7, 9, 12, 16, 19, 20, 25, 27, 28, 35, 36, 40, 41, 43, 44, 48, 56, 57, 60, 61, 65, 73, 75, 76, 78, and 79; and C.I. Acid Brown 2, 4, 13, 14, 19, 20, 27, 28, 30, 31, 39, 44, 45, 46, 48, 53, 100, 101, 103, 104, 106, 160, 161, 165, 188, 224, 225, 226, 231, 232, 236, 247, 256, 257, 266, 268, 276, 277, 282, 289, 294, 295, 296, 297, 299, 300, 301, and 302. These dyes may be suitably mixed together to provide a desired color. In particular, the addition of complementary colors is also preferred to print good black colors.

In the ink composition according to the present invention, the amount of the acid dye added may be properly determined. The amount of the acid dye added, however, is preferably about 0.1 to 15% by weight, more preferably about 1 to 10% by weight, based on the ink composition.

According to a preferred embodiment of the present invention, the dye has been purified to such an extent that the content of a salt as an impurity derived from the dye contained in the ink composition is up to 1% by weight. The utilization of this purified dye can advantageously ensure a high level of ejection stability of the ink composition, and, in addition, can suppress rusting of the printer in its metal portions.

According to a preferred embodiment of the present invention, the ink composition may contain other colorants in addition to the acid dye. In the case of printing on woven fabrics including fibers which are difficult to be dyed with the acid dye, for example, blended woven fabrics, the use of an ink composition containing the acid dye in combination with other colorant(s) can provide good printing. For example, for a woven fabric comprising a silk and a polyester, printing using the ink composition according to the present invention, which further comprises a disperse dye, can offer good print quality. According to another preferred embodiment of the present invention, the use of an ink composition containing other colorant(s) in addition to the acid dye can realize a wider range of color reproduction. For example, when textile printing is carried out on a pretreatment agent-coated silk, wool, or blended woven fabrics containing one of silk and wool, the addition of a reactive dye to the ink composition can realize a wide range of color reproduction.

According to still another preferred embodiment of the present invention, it is possible to use a method wherein the ink composition containing an acid dye according to the present invention and an ink composition containing a disperse dye are separately provided, and ejected through respective separate ink jet recording heads to perform textile printing. The order of ejection onto the woven fabric may be properly determined. Further, according to another preferred embodiment of the present invention, a plurality of ink compositions according to the present invention, which have the same color or similar colors, may be provided by varying the concentration or kind of the acid dye, followed by textile printing using these ink compositions. According to this embodiment, the gradation of printed images can be further improved. This embodiment has an additional advantage that the grainness of the intermediate to low density region can be relaxed.

(2) Compound represented by formula (I)

The ink composition for textile printing according to the present invention contains at least one compound represented by formula (I). In the ink composition, compounds represented by formula (I) may be added alone or as a mixture of two or more. In formula (I), EP1, EP2, and EP3 each independently represent an ethyleneoxy or propyleneoxy group. Thus, both the ethyleneoxy group and the propyleneoxy group may exist in the same molecule. Alternatively, only any one of the ethyleneoxy group and the propyleneoxy group may exist in one molecule. l, m, and n each are independently 0 or a natural number of 1 or more, provided that at least one of l, m, and n is 1 or more with the average of l+m+n in the whole compound represented by formula (I) contained in the ink composition being 1 to 30. The lower limit of the average value is preferably 2 or more, while the upper limit of the average value is preferably 28 or less. The average value is preferably in the range of 3 to 26. By virtue of the compound having the above range, the ink composition, even after allowed standing in a print head for a long period of time, can be immediately stably ejected. Further, the viscosity of the ink composition can be easily modified.

The compound represented by formula (I) may be produced by providing preferably glycerin as a starting compound and adding a target molar amount of ethylene oxide and/or propylene oxide to the starting compound in an alkaline atmosphere or the like. This production process generally provides a mixture of compounds represented by formula (I). A single compound may be isolated by distillation or the like. In general, in ink jet recording, the use of a compound represented by formula (I) having a distribution in the number of ethyleneoxy groups added and the number of propyleneoxy groups added is preferred from the viewpoint of improving the clogging preventive properties and the print quality.

Further, for the compound represented by formula (I), commercially available products may also be used, and examples thereof include Liponic EG-1 (a compound represented by formula (I) wherein EP1, EP2, and EP3 each represent an ethyleneoxy group and l+m+n is 26) and Liponic EG-7 (a compound represented by formula (I) wherein EP1, EP2, and EP3 each represent an ethyleneoxy group and l+m+n is 26) available from Lipo Chemicals Inc. (New Jersey, U.S.A.).

The addition of the compound represented by formula (I) can provide an ink composition which, when used in ink jet recording, can realize, on a high level, a combination of the prevention of clogging with good long-term storage stability. The ink composition containing the acid dye, in some cases, has a lower viscosity than that suitable for ink jet recording. The utilization of the compound represented by formula (I) has thickening effect and is also advantageous in that the viscosity of the ink can be regulated to a proper range. Further, the compound represented by formula (I) serves also as a humectant, and thus is also effective in reducing clogging. In particular, the compound represented by formula (I) has high moisture retention effect, and, as a result, even when the amount of the so-called wetting agent, such as glycerin, added to the ink composition is small, the effect of preventing clogging can be maintained. In some cases, the addition of the wetting agent other than the compound represented by formula (I), such as glycerin, can be omitted. The reduction of the amount of glycerin added or the elimination of the need to add glycerin can increase the content of water as a main solvent in the ink composition. This permits the acid dye as the colorant to be present in a larger amount in the ink composition, leading to an advantage that printed images having high print density can be realized.

The amount of the compound represented by formula (I) added to the ink composition may be properly determined so that the contemplated effect is attained by the addition of the compound, or otherwise properties of the ink composition described below can be realized. The amount of the compound represented by formula (I) added, however, is preferably not less than 1 by weight and not more than 15 by weight. More preferably, the lower limit of the amount of the compound added is 3 by weight, and the upper limit of the amount of the compound added is 10 by weight.

(3) Other ingredients and properties of ink composition

The ink composition according to the present invention contains a surfactant. The addition of the surfactant enables uniform wetting of the surface of the pretreated woven fabric and can realize images having no significant printing spots. Further, this can realize an ink composition which can penetrate into a woven fabric in a short time. Furthermore, an ink composition can be realized which, when used in a piezoelectric vibration type ink jet recording head, can improve the capability of bubbles within the print head, causative of ejection failure, to be discharged, and enables stable ejection.

Preferred surfactants include amphoteric surfactants, anionic surfactants, and nonionic surfactants. According to a preferred embodiment of the present invention, the surfactant is a nonionic surfactant. The surfactant can realize more stable ejection of the ink composition. Examples of preferred nonionic surfactants include ethylene glycol surfactants, polyhydric alcohol surfactants, and acetylene glycol surfactants. Among them, the utilization of acetylene glycol surfactants is preferred. Example of preferred acetylene glycol surfactants include compounds represented by the following formula:

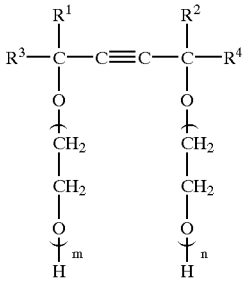

wherein $0 \leqq m+n \leqq 50$; and $R^1$, $R^2$, $R^3$, and $R^4$ each independently represent a $C_{1-6}$ alkyl group.

Commercially available products may be used as the compound represented by the above formula. Specific examples thereof include OLFINE Y, Surfynol 82, Surfynol 440, Surfynol 465, and Surfynol 485, (all the above products being manufactured by Air Products and Chemicals Inc.).

In a piezoelectric vibrator type ink jet recording head, the utilization of nonionic surfactants, preferably acetylene glycol surfactants, is advantageous because the amount of ink ejected per dot is stable to facilitate the reproduction of print density.

Further, the nonionic surfactant is effective in improving level dyeing ability and in preventing feathering or bleeding. In an ink composition for ink jet textile printing, which has much lower viscosity than the conventional printing paste used in a silk screen and the like, ink flow generally occurs on woven fabrics, leading to a drawback that it is difficult to provide the level dyeing ability. This phenomenon is likely to occur particularly in the printing of a blotted image. In the present invention, the term "printing of a blotted image" used herein refers to the printing of a full density blotted block having an area of 5 mm×5 mm or a larger area. The ink flow is likely to cause color-to-color bleeding at the boundary of colors. The addition of the nonionic surfactant can advantageously prevent these drawbacks. In particular, the acetylene glycol surfactant, by virtue of its excellent capability of evenly wetting the pretreated woven fabric and penetration, can effectively prevent the creation of spots in the blotted image and feathering or bleeding.

The amount of the surfactant, particularly the nonionic surfactant, added may be properly determined so that the contemplated effect of the surfactant can be attained, or otherwise the surface tension of the ink composition described below can be realized. The amount of the surfactant added, however, is preferably about 0.05 to 5% by weight, more preferably about 0.1 to 3% by weight, based on the ink composition.

According to a preferred embodiment of the present invention, the nonionic surfactant has a solubility of not less than 10 g/100 g in an organic solvent having a boiling point of 150° C. or above. The utilization of a nonionic surfactant and an organic solvent satisfying the above relationship is advantageous in that stable ejection of the ink composition from nozzles can be easily ensured under a high temperature environment (for example, at 30° C.). This effect is particularly advantageous in a piezoelectric vibrator type ink jet recording head.

According to a preferred embodiment of the present invention, the nonionic surfactant is added in combination with an alkylene glycol alkyl ether, a pyrrolidone solvent, or a thiolglycol to the ink composition. This can advantageously realize stable ejection over a wide temperature range. The application of this preferred embodiment to an ink jet recording head using a piezoelectric vibrator is particularly advantageous.

The main solvent of the ink composition according to the present invention is preferably water. Water may be pure water obtained by ion exchange, ultrafiltration, reverse osmosis, distillation or the like, or ultrapure water. Further, water, which has been sterilized by ultraviolet irradiation or by addition of hydrogen peroxide or the like, is suitable because, when the ink composition is stored for a long period of time, it can prevent the occurrence and growth of mold or bacteria.

The ink composition according to the present invention may contain an organic solvent. The organic solvent is preferably a polyhydric alcohol having a boiling point of 150° C. or above at atmospheric pressure. This organic solvent can effectively prevent the ink composition from drying and thus can prevent clogging of nozzles. Examples of preferred organic solvents include ethylene glycol, diethylene glycol, tripropylene glycol, propylene glycol, dipropylene glycol, tripropylene glycol, polyethylene glycol having a molecular weight of not more than 2000, 1,3-propylene glycol, isopropylene glycol, isobutylene glycol, 1,4-butanediol, 1,3-butanediol, 1,2-pentanediol, 1,5-pentanediol, 1,2-hexanediol, 1,6-hexanediol, 1,2,6-hexanetriol, 1,8-ocatanediol, 1,2-octanediol, glycerin, mesoerythritol, pentaerythritol, and thioglycol. Although the amount of the polyhydric alcohol organic solvent having a boiling point of 150° C. or above added may be properly determined, it is preferably not more than 50% by weight, more preferably 2 to 40% by weight, still more preferably about 2 to 20% by weight, based on the ink composition. These organic solvents may be used alone or as a mixture of two or more.

The ink composition according to the present invention preferably contains an alkylene glycol alkyl ether having a boiling point of 150° C. or above. This preferred embodiment can advantageously prevent the ink composition from drying in recording head nozzles. Further, the occurrence of air bubbles in the recording head can be prevented, and, even though air bubbles have been once created, the air bubbles can be rapidly allowed to disappear. As a result, the ink composition can be stably ejected for a long period of time. This ejection stabilization effect is particularly advantageous in an ink jet recording method using an ink jet recording head provided with a piezoelectric vibrator. The present inventors have further found that, when the ink composition with the alkylene glycol alkyl ether added thereto is used in combination with an ink jet recording head provided with a piezoelectric vibrator, the amount of ink ejected can be reduced. Specifically, regulating the amount of the alkylene glycol alkyl ether added advantageously enables the amount of ink ejected to be easily brought to the optimal amount range of ink ejected in the recording head. Alkylene glycol alkyl ethers having a boiling point of 150° C. or above include ethylene glycol monomethyl ether, ethylene glycol monoethyl ether, diethylene glycol monobutyl ether, triethylene glycol monomethyl ether, and triethylene glycol monobutyl ether. Among them, diethylene glycol monobutyl ether is particularly preferred. Although the amount of the alkylene glycol alkyl ether added may be properly determined, it is preferably about 0.5 to 30% by weight, more preferably about 3 to 20% by weight, still more preferably about 5 to 15% by weight, based on the ink composition. These organic solvents may be used alone or as a mixture of two or more.

In the ink composition according to the present invention, when the content of the acid dye is relatively high, the incorporation of a pyrrolidone solvent to the ink composition is preferred from the viewpoint of improving the ejection stability. Examples of preferred pyrrolidone solvents include 2-pyrrolidone, N-methyl-2-pyrrolidone, and 1,3-dimethylimidazolidinone. Further, according to a preferred embodiment of the present invention, the combined use of the pyrrolidone solvent and the acetylene glycol surfactant described above can further improve the ejection stability. This effect is particularly significant when the above preferred embodiment is used in combination with a piezoelectric vibration type ink jet recording head.

It is a matter of course that, preferably, liquid organic components constituting the ink composition according to the present invention are substantially compatible with each other or one another. Here "substantially compatible" means that the ink composition does not cause phase separation and they have solubility on such a level that precipitation does not occur. More preferably, "substantially compatible" means a compatibility on such a level that, upon the evaporation of water in the ink composition, phase separation does not occur between liquid components at room temperature. The ink composition having substantial compatibility can be more stably ejected.

According to a preferred embodiment of the present invention, the ink composition according to the present invention contains urea or a derivative thereof. Preferred examples of urea and urea derivatives include urea, dimethylurea, monomethylthiourea, thiourea, dimethylthiourea and other alkylureas and alkylthioureas. The urea or derivatives thereof can impart the effect of preventing clogging of nozzles to the ink composition and, at the same time, has hydrotrope effect. Further, the addition thereof can advantageously improve the textile print density. The addition of the thiourea is particularly effective in improving the level dyeing ability. Further, the addition of urea or derivatives thereof to the ink composition can reduce the amount of urea additives required in the pretreatment agent for woven fabrics, and, in some cases, can eliminate the need to add the urea additive. It can be said that reducing the amount of urea, which affects the environment, is favorable.

The amount of the urea or derivative thereof added may be properly determined so that the above-contemplated effect is attained. Preferably, however, the lower limit of the amount thereof is 1% by weight, and the upper limit of the amount thereof is 15% by weight. More preferably, the lower limit of the amount thereof is 3% by weight, and the upper limit of the amount thereof is 10% by weight. According to a preferred embodiment of the present invention, urea or an alkylurea is added in an amount of 2 to 10% by weight in combination with 1 to 5% by weight of thiourea.

According to a preferred embodiment of the present invention, the ink composition is preferably adjusted to pH 5.0 to 11.0, more preferably pH 7.0 to 9.5. Adjusting the pH value of the ink composition to the above can reduce damage to the woven fabric and can advantageously delay the corrosion of the printing machine in its metallic portions.

Further, the ink composition according to the present invention preferably contains a sequestering agent. The addition of the sequestering agent can realize stable ejection of the ink composition for a long period of time. Further, the addition of the sequestering agent can provide an ink composition which can realize stable density and hue on woven fabrics. Examples of sequesting agents usable herein include ethylenediaminetetraacetic acid (EDTA), EDTA salts, and hydroxyethylethylenediaminetriacetic acid (EDTA-OH). Although the amount of the sequestering agent added may be properly determined, it is preferably about 0.001 to 0.1% by weight, more preferably 0.005 to 0.03% by weight.

The ink composition according to the present invention may contain, in addition to the above ingredients, additives for improving various properties of the ink composition. An example of the additive is a preservative. Examples of preferred preservatives include Proxel CRL, Proxel BDN, Proxel GXL, Proxel XL-2, Proxel IB, and Proxel TN.

According to a preferred embodiment of the present invention, the ink composition according to the present invention contains a rust preventive agent. The addition of the rust preventive agent can prevent corrosion of printer members including a recording head and can realize stable ink jet textile printing for a long period of time. Examples of preferred rust preventive agents include benzotriazole. The amount of the rust preventive agent added is preferably about 0.005 to 0.05% by weight.

According to a preferred embodiment of the present invention, the viscosity at 20° C. of the ink composition according to the present invention is brought to not more than 8.0 m.Pa.s, more preferably 1.5 to 6.0 m.Pa.s, particularly from the viewpoint of the ejection stability of the ink composition.

Further, according to a preferred embodiment of the present invention, the surface tension of the ink composition according to the present invention is preferably not more than 50 mN/m, more preferably 40 to 25 mN/m.

Preferably, the ink composition according to the present invention is deaerated before feed into a printer. The deaerated ink composition facilitates the loading of the ink composition into the recording head, and, at the same time, can ensure the ejection stability of the ink and, upon cleaning operation, can easily return a nozzle, suffering from a failure to eject, to a normal state. These effects are more significant when the deaerated ink composition is used with an ink jet recording head using a piezoelectric vibrator. The ink composition can be deaerated by any method without particular limitation. For example, allowing the ink composition to stand under reduced pressure can carry out the deaeration. This deaerated ink composition is placed in a container, which can be substantially sealed off from the open air, for example, a cartridge or an aluminum pack, followed by hermetic sealing. This can keep the ink composition in a deaerated state until the ink composition is loaded into a printer. The degree of deaeration is preferably not more than 10 ppm, more preferably not more than 5 ppm, in terms of the residual amount of nitrogen at 15° C.

Ink jet textile printing method

Woven fabrics, to which the ink composition according to the present invention can be favorably applied, include those composed mainly of vegetable fibers, animal fibers, or amide fibers. Preferred examples of woven fabrics include wool, silk, nylon, and blended fabrics containing at least one of the above fibers. According to a preferred embodiment of the present invention, the ink composition of the present invention is suitable for use in printing an animal protein fibers, such as silk and wool, polyamide fibers, and blended fibers containing at least one of the animal protein fibers and the polyamide fibers.

Preferably, these woven fabrics are treated with the following pretreatment agent before the application of the ink composition thereto. Preferred pretreatment agents are those containing a sizing agent. Preferred examples thereof include those containing naturally occurring gums, such as guar gum and locust bean gum, starches, sodium alginate, seaweeds, such as glue plants, barks or skins of plants, such as pectinic acid, cellulose derivatives, such as methylcellulose, ethylcellulose, hydroxyethylcellulose, and carboxymethylcellulose, chemically modified starches, such as roast starch, alpha starch, carboxymethyl starch, carboxyethyl starch, and hydroxyethyl starch, processed naturally occurring gums, such as silat gum-and roast bean gum-based processed gums, alginic acid derivatives, and synthetic sizing agents or emulsions of polyvinyl alcohol, polyacrylic esters and the like. Sizing agents having poor dyeability with the reactive dye used are particularly preferred.

The addition of a hydrotrope to the pretreatment agent for woven fabrics, to which the ink composition according to the present invention is applied, is preferred. Hydrotropes usable herein include urea and alkylureas, such as dimethylurea, thiourea, monomethylthiourea, and dimethylthiourea. The addition of the hydrotrope can advantageously improve the print density. When urea is added in combination with an alkylurea and thiourea, the necessary amount of urea added can be reduced. The addition of the hydrotrope can improve the stability of the pretreatment agent and, in addition, has the effect of effectively preventing cracking in the fabric subjected to padding. The utilization of the thiourea as the hydrotrope is particularly preferred from the viewpoint of improving the level dyeing ability. The addition of the hydrotrope to the ink composition can reduce the necessary amount of the hydrotrope added to the pretreatment agent, and, in some cases, can eliminate the need to add the hydrotrope to the pretreatment agent. It can be said that reducing the amount of urea, which affects the environment, is favorable. Although the amount of the hydrotrope to the pretreatment agent added may be suitably determined, it is preferably not more than 15% by weight, more preferably not more than 10% by weight.

According to a preferred embodiment of the present invention, the pretreatment agent contains a pH adjustor. Preferred examples of pH adjustors include ammonium salts of acids, for example, ammonium sulfate, ammonium tartrate, and sodium secondary phosphate. The addition of these pH adjustors can advantageously improve the stability of hue and the dyeing capability. Although the amount of these pH adjustors added may be properly determined by taking the kind of dyes or the like into consideration, the amount is preferably about 0.2 to 5% by weight, more preferably about 0.5 to 3% by weight.

The pretreatment agent may be coated onto a woven fabric by any conventional method, for example, by padding. In this case, the mangle pressure, the speed, the drying time, etc. may be suitably determined. The pickup in the padding is preferably about 40 to 90%, more preferably about 60 to 80%. Increasing the pickup can generally improve the fixation density.

The ink composition according to the present invention is deposited onto the woven fabric by means of an ink jet recording device described below. According to a preferred embodiment of the present invention, the density of the ink ejected is preferably not less than 120 dots/inch, and, in the case of the printing of blotted images, the amount of the ink deposited is preferably not less than 5 $g/m^2$, from the viewpoint of reducing the grainness of printed images to realize high-density images.

The woven fabric with the ink composition deposited thereon is preferably post-treated to accelerate the fixation of the reactive dye onto the fibers and, thereafter, to satisfactorily remove the colorant and other ink ingredients remaining unfixed and the pretreatment agent. According to a preferred embodiment of the present invention, the post-treatment is divided into several steps. At the outset, preferably, after the ink composition is deposited onto the woven fabric, this woven fabric is allowed to stand at room temperature to 150° C. for 0.5 to 30 min to predry the deposited ink composition. This predrying can improve the print density and can effectively prevent feathering or bleeding. The predrying cannotes the penetration of the ink composition into the woven fabric.

According to a preferred embodiment of the present invention, the predrying may be carried out by continuous heat drying. In this case, the woven fabric in a roll form is fed to an ink jet textile printing machine, printed, and then passed into the step of drying before the printed woven fabric is wound. The dryer may be connected directly to the textile printing machine, or alternatively may be provided separately from the textile printing machine. The drying in the dryer is preferably carried out at a temperature of 150° C. or below for 0.5 to 30 min. Preferred drying methods include air convection, heat roll direct mounting, and irradiation methods.

Preferably, the predried woven fabric is steamed. The steaming may be carried out under conditions which have been determined by taking into consideration the type of the woven fabric and the like. Preferably, however, the steaming is carried out by placing the predried woven fabric in an environment of humidity 50 to 100% (more preferably, humidity 80 to 100%) and temperature 90 to 120° C. (preferably 95 to 105° C.) for 3 to 120 min (preferably 5 to 40 min). Preferably, the steamed woven fabric is then washed with a surfactant-containing (preferably a nonionic surfactant-containing) warm water. The printed woven fabric post-treated in this way has excellent color development and fastness properties and has no significant feathering or bleeding of the ink.

According to a preferred embodiment of the present invention, in the step of fixation among the post treatment steps, it is preferred to vary conditions for the fixation, particularly the fixation time, depending upon the types of woven fabrics used. For example, when the woven fabric is wool, the fixation time is preferably 20 to 120 min, more preferably about 30 to 90 min. When the woven fabric is silk, the fixation time is preferably 5 to 40 min, more preferably about 15 to 30 min. When the woven fabric is nylon, the fixation time is preferably about 5 to 90 min, more preferably about 10 to 60 min.

Ink jet recording apparatus

Textile printing using the ink composition according to the present invention is carried out by an ink jet recording apparatus. The ink jet recording apparatus may be any of the so-called "piezoelectric head type ink jet recording apparatus." In this type of apparatus, ink droplets are formed by mechanically changing the volume of a piezoelectric element, and then ejected. As another type of the apparatus, there is the so-called "bubble jet type or thermal jet type ink jet recording apparatus" in which a thermal energy is applied to an ink composition to cause volume expansion through which ink droplets are formed and ejected.

The ink compositions according to the present invention can be advantageously used in an ink jet recording method using a piezoelectric element. Piezoelectric ink jet recording heads have very good durability and thus are particularly preferred in applications where the ink composition should be stably ejected for a long period of time, such as textile printing. The ink compositions according to the present invention have very good compatibility with the piezoelectric ink jet recording head, and can realize stable continuous ejection over a wide temperature range for a long period of time. This is very advantageous in printing of continuous woven fabrics, where enormous amounts of inks should be ejected, and is the greatest advantages obtained by the present invention.

According to a preferred embodiment of the present invention, the ink compositions according to the present invention are used with an ink jet recording head having a nozzle plate, of which the surface layer portion has been treated for rendering the material ink-repellent. The combination of the ink compositions according to the present invention with the ink jet recording head subjected to the treatment for rendering the material ink-repellent can reduce the ink droplet trajectory directionality problem and thus can print good images on woven fabrics. According to a preferred embodiment of the present invention, the inner surface of the nozzle holes (that is, ink ejection port) has also been treated for rendering the material ink-repellent. The additional treatment of the inner surface of the nozzle hole for rendering the material ink-repellent can stabilize the position of meniscus of the ink composition and consequently can further improve the ejection stability. Further, the treatment for rendering the material ink-repellent can advantageously make it difficult for the ink composition to be deposited onto the nozzle plate surface, and hence can retain the ink repellency of the nozzle surface for a longer period of time.

The material for the nozzle plate of the ink jet recording head, through which the ink compositions of the present invention are ejected, is not particularly limited. Preferred materials include metals, ceramics, silicon, glass, and plastics. More preferred are single metals, such as titanium, chromium, iron, cobalt, nickel, copper, zinc, tin, and gold, alloys, such as nickel-phosphorus alloy, tin-copper-phosphorus alloy, copper-zinc alloy, and stainless steel, polycarbonate, polysulfone, acrylonitrile-butadiene-styrene copolymer, polyethylene terephthalate, polysulfone, and various photosensitive resins.

The treatment for rendering the nozzle plate ink-repellent may be carried out by any method without particular limitation. Preferably, however, the treatment is carried out by codeposition. The codeposition may be carried out, for example, by immersing a plate member in a liquid containing metal ions and particles of a water-repellent polymeric resin dispersed by charges, and forming an ink-repellent layer on the surface of the nozzle plate while stirring. Water-repellent polymeric resin materials usable herein include resins, such as polytetrafluoroethylene, polyperfluoroalkoxybutadiene, polyfluorovinylidene, polyfluorovinyl, and polydiperfluoroalkyl fumarate. These resins may be used alone or as a mixture of two or more. Metal ions usable herein include nickel, copper, silver, tin, and zinc ions. Preferred are materials having high surface hardness and excellent abrasion resistance, such as nickel, nickel-cobalt alloy, and nickel-boron alloy.

Specific example of the ink jet recording head, which can favorably eject the ink compositions according to the present invention, include heads described in Japanese Patent Laid-Open Nos. 339656/1992 and 339662/1992, which are incorporated herein by reference. More specifically, as shown in FIG. 1, an ink-repellent layer composed of a codeposit of a fluoropolymer formed by electrolysis is provided on the outer surface of a nozzle plate having an ink ejection port. FIG. 1 is a cross-sectional schematic view of this ink jet recording head. The ink jet recording head comprises at least a member 11 defining an ink passage, an ink passage 12, a member 13 defining a face having an ink ejection port 14, an ink-repellent, surface-treated layer 15, composed of a codeposit of a fluoropolymer, provided on the surface of the member 13, and piezoelectric element 16, and a drive line 17 for driving the piezoelectric element. The surface-treated layer 15 can realize stable ejection of the ink composition.

Figure 2:
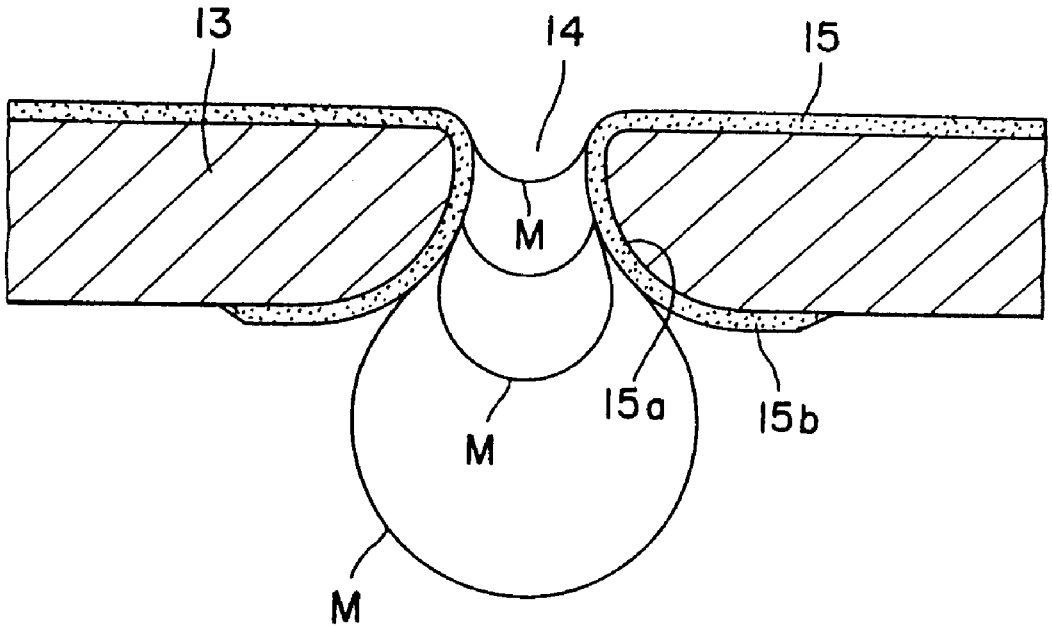
FIG. 2 is a diagram showing a plate in another embodiment of the ink jet recording head which can favorably eject the ink composition according to the present invention and wherein a codeposit of the same type as the ink-repellent, surface-treated layer 15 is provided from the inner surface 15*a* to the back surface 15*b* of the ink ejection port 14.

Another specific example of the ink jet recording head, which can favorably eject the ink compositions according to the present invention, is a head described in Japanese Patent Laid-Open No. 116327/1993, which is incorporated herein by reference. More specifically, in a recording head having a nozzle plate as shown in FIG. 2, an ink-repellent coating is evenly provided on the surface of the nozzle plate, the inner surface of a nozzle hole extending to this nozzle plate surface, and the peripheral portion of the nozzle hole extending to the backside of the nozzle plate. FIG. 2 is a diagram showing an ink ejection port and its vicinity in a nozzle plate. This nozzle plate corresponds to the member 13 shown in FIG. 1, and the other construction may be the same as that shown in FIG. 1. In this recording head, the same codeposit as used in the ink-repellent surface-treated layer 15 is provided from the inner surface 15*a* to the back surface 15*b* of the ink ejection port 14. This construction is advantageous in that, for example, even though meniscuses of the ink composition indicated by M in the drawing are greatly vibrated by a pressure fluctuation or the like within an ink chamber and greatly retreated toward the ink chamber, the meniscuses can still stably have the spherical surface, permitting a record to be written at a high frequency without causing any ink droplet trajectory directionality problem, dropouts of dots and the like.

Figure 3:
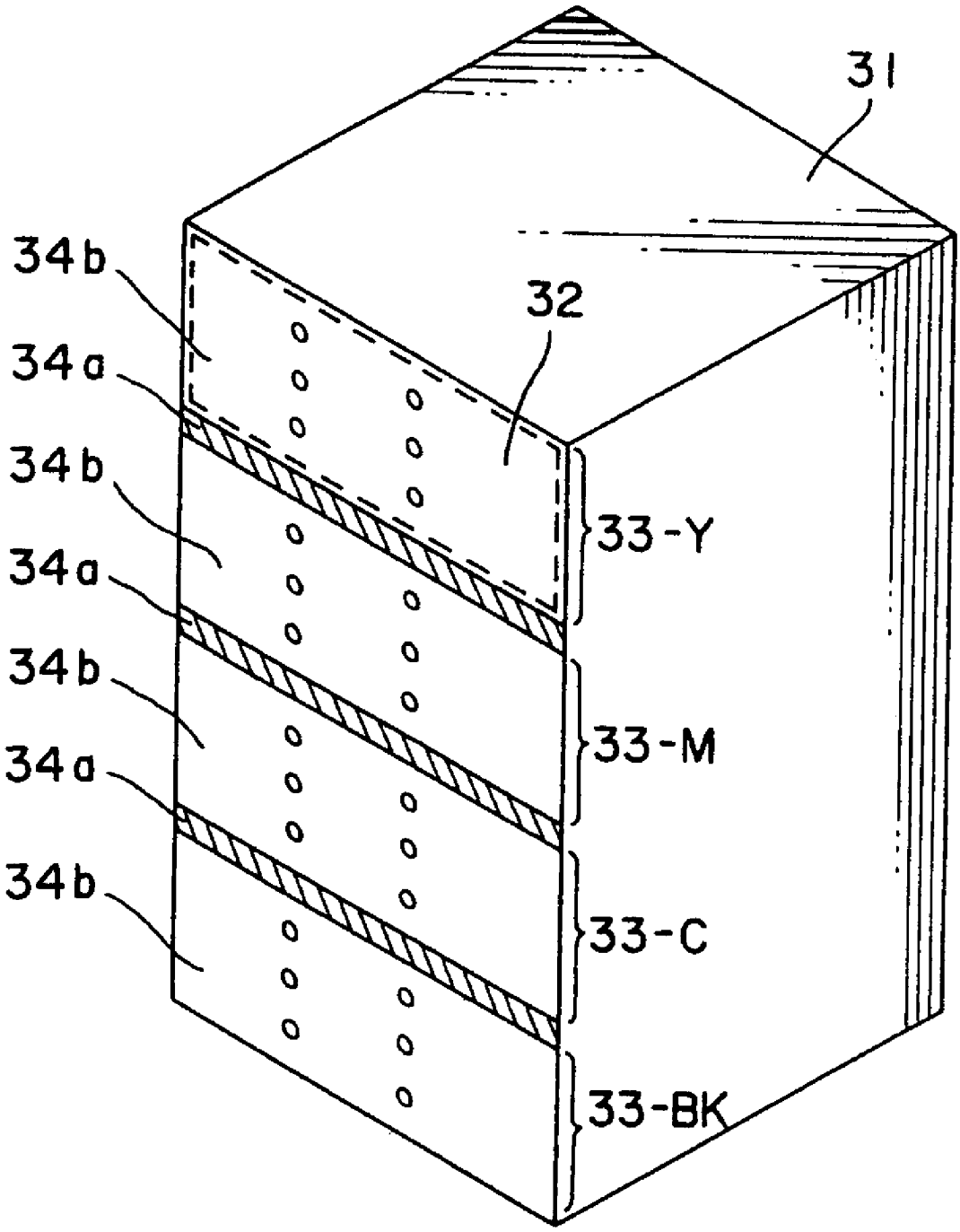
FIG. 3 is a diagram showing a further embodiment of the ink jet recording head which can favorably eject the ink composition according to the present invention and wherein either regions 34*a* between adjacent groups of nozzles or regions 34*b* within each group of nozzles have been treated for rendering the regions ink-repellent while the regions 34*a* or the regions 34*b*, which are not subjected to the treatment for rendering the regions ink-repellent, have been hydrophilified.

A further specific example of the ink jet recording head, which can favorably eject the ink compositions according to the present invention, is a head described in Japanese Patent Laid-Open No. 122210/1994, which is incorporated herein by reference. More specifically, as shown in FIG. 3, in a print head 31, each group of nozzles 33-Y, 33-M, 33-C, and 33-BK, wherein nozzles for ejecting the ink composition of the same color are perpendicularly arranged on a nozzle face 32, are arranged in a direction perpendicular to the printing scanning direction. On the nozzle face 32, either regions 34*a* between adjacent groups of nozzles or regions 34*b* within each group of nozzles have been treated for rendering the regions ink-repellent, for example, to bring the contact angle of the treated region with the ink composition to not less than 80 degrees, while the regions 34*a* or the regions 34*b*, which are not subjected to the treatment for rendering the regions ink-repellent, have been hydrophilified, for example, to bring the contact angle of the treated region with the ink composition to not more than 30 degrees. When the regions 34*a* between adjacent groups of nozzles are hydrophilified, and, at the same time, the regions 34*b* within each group of nozzles are treated for rendering the regions ink-repellent, the ink composition is repelled in the periphery of the nozzles and is dragged into the nozzles. Therefore, uneven wetting of the periphery of the nozzles by the ink composition does not occur, and this can ensure stable ejection of the ink composition. The ink composition, which has not been dragged into the nozzles, is held in the regions, between adjacent groups of nozzles, which have been hydrophilified. This can prevent color mixing between adjacent inks. Conversely, when the regions 34*a* between adjacent groups of nozzles are treated for rendering the regions ink-repellent and, at the same time, the regions 34*b* within each group of nozzles are hydrophilified, the ink composition is spread due to wetting in the periphery of the nozzles, ensuring stable ejection of the ink by virtue of even wetting of the periphery of the nozzles by the ink. The ink composition, which has been spread to between adjacent groups of nozzles, is repelled by the regions 34*b*, between adjacent groups of nozzles, which have been treated for rendering the regions 34*b* ink-repellent. This can prevent color mixing between adjacent inks.

EXAMPLES

Preparation of ink compositions

Ink 1 was prepared according to the following procedure. Water (52 g) of 40° C. was placed in a 110-cc sample bottle. A 10 wt % aqueous solution (5 g) of Surfynol 465, 2.5 g of a 10 wt % aqueous solution of a preservative Proxel XL, and 0.5 g of a 1 wt % aqueous solution of a chelating agent EPDA were added thereto while stirring with a magnetic stirrer, followed by the addition of 10 g of Liponic EG-1 and 7 g of Acid Yellow 49. The mixture was stirred with heating by means of a magnetic stirrer to dissolve the dye. Further, 10 g of diethylene glycol, 8 g of glycerin, and 5 g of diethylene glycol mono-n-butyl ether were added thereto, and the mixture was stirred for 10 min by means of a magnetic stirrer to prepare an ink.

| Ink 1 | |
|---|---|
| C.I. Acid Yellow 49 | 7 wt % |
| Liponic EG-1 | 10 wt % |
| Diethylene glycol | 10 wt % |
| Glycerin | 8 wt % |
| Diethylene glycol mono-n-butyl ether | 5 wt % |
| Surfynol 465 | 0.5 wt % |
| Proxel XL | 0.25 wt % |
| EPDA | 0.005 wt % |
| Water | Balance |

Inks 2 to 7 having the following compositions were prepared in the same manner as in ink 1.

| | |
|---|---|
| Ink 2 | |
| C.I. Acid Red 52 | 7 wt % |
| Liponic EG-7 | 7 wt % |
| Diethylene glycol | 7 wt % |
| Triethylene glycol mono-n-butyl ether | 3 wt % |
| Surfynol 465 | 0.7 wt % |
| N-Methyl-2-pyrrolidone | 5 wt % |
| Preservative | 0.2 wt % |
| Chelating agent | 0.01 wt % |
| Water | Balance |
| Ink 3 | |
| C.I. Acid Blue 140 | 10 wt % |
| Compound of formula (I) wherein EP1, EP2, and EP3 each represent an ethyleneoxy group and 1 + m + n is 3 | 5 wt % |
| 2-Pyrrolidone | 5 wt % |
| Surfynol 465 | 0.9 wt % |
| Preservative | 0.15 wt % |
| Chelating agent | 0.015 wt % |
| Water | Balance |
| Ink 4 | |
| C.I. Acid Black 52 | 7 wt % |
| Compound of formula (I) wherein EP1, EP2, and EP3 each represent an ethyleneoxy group and 1 + m + n is 7 | 8 wt % |
| Diethylene glycol | 5 wt % |
| Thiodiglycol | 3 wt % |
| Surfynol 485 | 1.1 wt % |
| Preservative | 0.1 wt % |
| Chelating agent | 0.02 wt % |
| Water | Balance |

-continued

| | |
|---|---|
| Ink 5 | |
| Acid Yellow 11 | 6 wt % |
| Compound of formula (I) wherein EP1, EP2, and EP3 each represent an propyleneoxy group and 1 + m + n is 3 | 15 wt % |
| Thiodiglycol | 15 wt % |
| Anionic surfactant | 10 wt % |
| Preservative | 0.5 wt % |
| Chelating agent | 0.05 wt % |
| Water | 0.025 wt % |
| | Balance |
| Ink 6 | |
| C.I. Acid Red 26 | 8 wt % |
| Liponic EG-7 | 7 wt % |
| Triethylene glycol mono-n-butyl ether | 3 wt % |
| Urea | 7 wt % |
| Surfynol 465 | 0.7 wt % |
| Preservative | 0.2 wt % |
| Chelating agent | 0.01 wt % |
| Water | Balance |
| Ink 7 | |
| C.I. Acid Red 138 | 8 wt % |
| Liponic EG-7 | 10 wt % |
| Surfynol 465 | 0.7 wt % |
| Preservative | 0.2 wt % |
| Chelating agent | 0.01 wt % |
| Water | Balance |
| Ink 8 | |
| C.I. Acid Black 155 | 8 wt % |
| Compound of formula (I) wherein EP1, EP2, and EP3 each represent an ethyleneoxy group and 1 + m + n is 10 | 10 wt % |
| Surfynol 465 | 0.7 wt % |
| Preservative | 0.2 wt % |
| Chelating agent | 0.01 wt % |
| Water | Balance |

Pretreatment agent for woven fabric

A starch glue (15 g) was added to one liter of water with slow stirring over a period of about 4 hr. Further, 1.0 g of urea and 0.5 g of thiourea were added thereto with stirring. The mixture was allowed to stand for one day. After the absence of any undissolved lump was confirmed, 25% ammonium tartrate (5% o.w.p.) was added thereto. The mixture was stirred for additional one hr. Thus, pretreatment agent 1 was prepared.

Pretreatment agent 2 was prepared in the same manner as used in the preparation of pretreatment agent 1, except that dimethylurea was used instead of urea and dimethylthiourea was used instead of thiourea.

Padding

Padding of the pretreatment agent was carried out at room temperature by using HVF 350 manufactured by Matisse. More specifically, a silk fabric, which had been previously cut into a size of 210 mm×315 mm, was subjected to padding under conditions of pressure 2 bar, speed 3 m/min, and pickup 80%.

Ink jet textile printing

A modified ink jet printer MJ 930C (manufactured by Seiko Epson Corporation) was filled with the ink prepared above, and textile printing was then carried out on the silk fabric which had been subjected to padding of the pretreatment agent. In this case, the printer was provided with an ink jet recording head wherein a nozzle plate and a part of nozzle holes in the printer had been subjected to codeposition of nickel and Teflon to render the material ink-repellent.

Post-treatment

Fixation was carried out by means of a steamer Model DHe manufactured by Matisse under conditions of temperature 102° C., humidity not less than 98%, and steaming time 30 min. The fixation was followed by rinsing. In the first rinsing, the printed fabric was immersed in an aqueous solution (room temperature) of a nonionic surfactant (1.5 g/liter) and sodium carbonate (1 g/liter). The immersion was carried out for 10 min with occasional stirring. The bath ratio was 1/50. The printed fabric was taken out of the bath, lightly squeezed, and then subjected to second rinsing. In the second rinsing, the prerinsed fabric was immersed in an aqueous solution (50° C.) of a nonionic surfactant (1.5 g/liter) and sodium carbonate (1 g/liter). The second rinsing was carried out for 15 min with occasional stirring. The bath ratio was 1/50. After thorough rising with water, the fabric was air dried and then ironed to prepare a printed fabric.

Evaluation test 1

Textile printing was carried out for combinations of ink compositions and pretreatment agents shown in the following table. The OD value of the printed portion was measured on the printed fabrics thus obtained. The results were as follows.

| Ink composition | Pretreatment agent | OD value |
|---|---|---|
| Ink 8 | Pretreatment agent 1 | 1.41 |
| Ink 8 | Pretreatment agent 2 | 1.43 |

Evaluation test 2

Immediately after the preparation of the ink composition, textile printing was carried out in the same manner as used in evaluation test 1. Thus, a printed fabric was prepared. Separately, after the preparation of the ink composition, the ink composition was allowed to stand at a temperature of 50° C. for one week, and then used to carry out textile printing in the same manner as used in evaluation test 1. Thus, another printed fabric was prepared. The OD value of the printed portion was measured on the printed fabric using the ink composition before standing and the printed fabric using the ink composition after standing. The results were as summarized in the following table. In evaluation test 2, pretreatment agent 2 was used as a pretreatment agent in combination with all the ink compositions.

| Ink composition | OD value before standing | OD value after standing |
|---|---|---|
| Ink 1 | 1.35 | 1.35 |
| Ink 2 | 1.39 | 1.38 |
| Ink 3 | 1.47 | 1.47 |
| Ink 4 | 1.40 | 1.40 |
| Ink 5 | 1.34 | 1.34 |
| Ink 6 | 1.40 | 1.39 |
| Ink 7 | 1.39 | 1.39 |
| Ink 8 | 1.43 | 1.42 |

Evaluation test 3

Evaluation test 3 was carried out in the same manner as used in evaluation test 2, except that the standing temperature was changed to 60° C. The results were as summarized in the following table.

| Ink composition | OD value before standing | OD value after standing |
|---|---|---|
| Ink 1 | 1.35 | 1.33 |
| Ink 2 | 1.39 | 1.38 |
| Ink 3 | 1.47 | 1.46 |
| Ink 4 | 1.40 | 1.39 |
| Ink 5 | 1.34 | 1.34 |
| Ink 6 | 1.40 | 1.39 |
| Ink 7 | 1.39 | 1.38 |
| Ink 8 | 1.43 | 1.42 |

Evaluation test 4

An ink jet printer MJ 930C was filled with ink 1, and printing was then carried out. In this case, ink droplets could be ejected from all nozzles of the recording head without any droplet trajectory directionality problem. This printer was then allowed to stand at 40° C. for 7 days, followed by printing without use of the cleaning function provided in the printer. As a result, ink droplets could be ejected from all the nozzles without any droplet trajectory directionality problem.

Evaluation test 5

An ink jet printer MJ 930C, provided with a recording head having a nozzle plate not subjected to any treatment for rendering the material ink-repellent, was filled with inks 1 to 4, and printing was then carried out. In this case, ink droplets could be ejected from all nozzles of the recording head without any droplet trajectory directionality problem. This printer was then allowed to stand at 40° C. for 7 days, followed by printing without any cleaning operation. As a result, ink droplets could be ejected from all the nozzles with a deviation of the ink droplet trajectory direction of about 4% from the normal droplet trajectory direction. Textile printing was then carried out on a woven fabric which had been treated with pretreatment agent 1, followed by predetermined fixation and rinsing. The printed image was visually inspected. As a result, it was found that there was no problem associated with the droplet trajectory directionality and the printed image had high quality. After the printer was allowed to stand at 40° C. for 7 days, the print head was once subjected to cleaning operation. As a result, the droplet trajectory directionality problem was eliminated. Thereafter, printing was carried out on 100 sheets of paper of size A4. In this printing, any unfavorable phenomenon did not occur.

Evaluation test 6

An ink jet printer MJ 930C was filled with inks 1 to 4, followed by printing on 20,000 sheets of recording paper of size A4 at environmental temperatures of 0° C., 20° C., and 40° C. As a result, ink droplets could be ejected from all the nozzles at all the environmental temperatures, and no droplet trajectory directionality problem occurred.

Evaluation test 7

The ink jet printer MJ 930C, provided with a recording head having a nozzle plate not subject to any treatment for rendering the material ink-repellent, used in evaluation test 5 was filled with inks 5 to 8. Printing was then carried out on 20,000 sheets of recording paper of size A4 at environmental temperatures of 0° C., 20° C., and 40° C. As a result, ink droplets could be ejected from all the nozzles at all the environmental temperatures. A droplet trajectory directionality problem occurred in several nozzles after printing on about 3,000 sheets of paper at 40° C. Textile printing was then carried out using this recording head on the pretreated fabric described above, followed by fixation. As a result, any problem associated with the droplet trajectory directionality was not observed in the printed image. It is considered that slight blurring of the ink on the fabric upon steaming has made a deterioration in image by a deviation of the ink droplet trajectory direction from the normal ink droplet trajectory direction negligible.

The following ink compositions were prepared.

| | |
|---|---|
| Ink 9 | |
| C.I. Acid Black 52 | 7 wt % |
| Diethylene glycol | 10 wt % |
| Glycerin | 10 wt % |
| Surfynol 465 | 0.5 wt % |
| Proxel XL-2 | 0.1 wt % |
| EDTA | 0.02 wt % |
| Water | Balance |
| Ink 10 | |
| C.I. Acid Black 52 | 7 wt % |
| Diethylene glycol | 5 wt % |
| Liponic EG-1 | 4 wt % |
| Surfynol 465 | 0.8 wt % |
| Proxel XL-2 | 0.1 wt % |
| EDTA | 0.02 wt % |
| Water | Balance |

Evaluation test 8

Inks 9 and 10 were loaded into nine ink jet printers (EM 900C, manufactured by Seiko Epson Corporation). Printing was carried out on 20,000 sheets of recording paper of size A4 by means of each printer. In this case, for three printers among the nine printers, the printing was carried out at an environmental temperature of 0° C.; for three printers among the remaining six printers, the printing was carried out at an environmental temperature of 20° C.; and for the remaining three printers, the printing was carried out at an environmental temperature of 40° C. As a result, the inks could be normally printed out without causing any unfavorable phenomenon.

After the above test, the printers, through which the ink was ejected at 0° C., were allowed to stand at 40° C. for 2 weeks; the printers, through which the ink was ejected at 20° C., were allowed to stand at 50° C. for 2 weeks; and the printers, through which the ink was ejected at 40° C., were allowed to stand at 60° C. for 2 weeks. After the standing, printing was again carried out. At that time, the numbers of cleaning operations (CL) necessary for the ink to be normally ejected through all the nozzles were determined. The results were as summarized in the following table.

| Standing temp. | 40° C. | 50° C. | 60° C. |
|---|---|---|---|
| Ink 9 | Once for all the three printers | Twice for two printers Four times for one printer | Five times for two printers Six times for one printer |
| Ink 10 | Once for all the three printers | Twice for all the three printers | Four times for all the three printers |

What is claimed is:

1. An ink composition for ink jet textile printing, comprising an acid dye, a surfactant, water, at least one member selected from the group consisting of urea, thiourea, alky-substituted urea, and alkylthioureas, and at least one compound represented by formula (I), said ink composition having a viscosity of not more than 8.0 m.PA.s (20° C.):

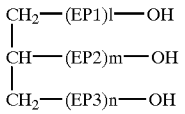

(I)

wherein

EP1, EP2, and EP3 each independently represent an ethyleneoxy or propyleneoxy group and l, m, and n each are independently 0 or a natural number of 1 or more, provided that at least one or l, m, or n is 1 or more average of l+m+n in the whole compound represented by formula (I) contained in the ink composition being 1 to 30.

2. The ink composition according to claim 1, wherein the content of a salt as an impurity derived from the dye contained in the ink composition is up to 1% by weight.

3. The ink composition according to claim 1, which has a surface tension of not more than 50 mN/m.

4. The ink composition according to claim 1, which comprises a polyhydric alcohol and/or an alkylene glycol alkyl ether having a boiling point of 150° C. or above.

5. The ink composition according to claim 1, wherein the surfactant is an acetylene glycol derivative.

6. The ink composition according to claim 1, which further comprises a sequestering agent.

7. The ink composition according to claim 1, which further comprises benzotriazole as a rust preventive agent.

8. An ink jet textile printing method comprising the steps of: ejecting ink droplets of an ink composition; and depositing the ink droplets onto a woven fabric, said ink composition being one according to any one of claims 1 to 4 or 5 to 7, said ink droplets being ejected by means of an ink jet recording head using a piezoelectric vibrator.

9. The method according to claim 8, wherein the ink composition comprises alkylene glycol alkyl ether.

10. The method according to claim 8, wherein an ink-repellent layer is provided on the surface of a nozzle plate of the ink jet recording head.

11. The method according to claim 10, wherein the ink-repellent layer is provided also on the inner surface of nozzle holes.

12. The method according to claim 11, wherein the ink-repellent layer has been formed by codeposition.

13. The method according to claim 8, wherein the woven fabric has been previously treated with a pretreatment agent comprising a sizing agent and pH on adjustor.

14. The method according to claim 13, wherein the woven fabric is an animal protein fiber, a polyamide fiber, or a blended fiber comprising at least one of the animal protein fiber and the polyamide fiber.

15. The method according to claim 14, wherein the animal protein fiber is silk or wool.

16. The method according to claim 8, wherein both urea and dicyandiamide are contained as the hydrotrope contained in the ink composition and/or the pretreatment agent.

17. The method according to claim 8, wherein, after the ink composition is deposited onto the woven fabric, the woven fabric is then allowed to stand in an environment of humidity 50 to 100% and temperature 90 to 110° C. for 4 to 25 min to perform fixation treatment and is then rinsed with warm water containing at least an anionic surfactant or a nonionic surfactant.

18. The method according to claim 8, wherein the density of the ink ejected is not less than 120 dots/inch, and, in the case of the printing of blotted images, the amount of the ink ejected is not less than 5 $g/m^2$.

19. The method according to claim 8, wherein at least an acid for pH adjustment if used as the pretreatment agent for the woven fabric.

20. A woven fabric printed by the ink jet textile printing method according to claim 8.

21. An ink composition according to claim 1, wherein the acid dye is present in the composition in an amount of about 0.1 to 15% by weight, the surfactant is present in the composition in an amount of about 0.05 to 5% by weight, the compound of formula (I) is present in an amount of about 1 to 15% by weight, and wherein all components of the ink composition, including water, are present in the composition in respective amounts sufficient to provide the composition with viscosity between 1.5 to 6.0 m.Pa.s (20° C.).

22. An ink composition according to claim 21 wherein the acid dye is present in the ink composition in an amount of at least 6 weight percent.

23. An ink composition according to claim 22, wherein water is present in the ink composition in an amount of between 59–83% by weight.

24. An ink composition according to claim 23, wherein the composition consists essentially of the acid dye, the surfactant, the compound of formula (I) and water.

* * * * *